United States Patent [19]

Beiswenger

[11] 4,070,830

[45] Jan. 31, 1978

[54] INTEGRAL AIR SWITCHING DIVERTER VALVE

[75] Inventor: David W. Beiswenger, Brockport, N.Y.

[73] Assignee: General Motors Corporation, Detroit, Mich.

[21] Appl. No.: 735,047

[22] Filed: Oct. 22, 1976

[51] Int. Cl.[2] ..... F02B 75/10

[52] U.S. Cl. ..... 60/290; 60/306

[58] Field of Search ..... 60/289, 290, 306

[56] References Cited

U.S. PATENT DOCUMENTS

| | | | |
|---|---|---|---|
| 3,738,109 | 6/1973 | Tatsutomi | 60/290 |
| 3,924,408 | 12/1975 | Beiswenger | 60/290 |
| 3,924,409 | 12/1975 | Heilman | 60/290 |
| 3,934,413 | 1/1976 | Beiswenger | 60/290 |
| 3,948,045 | 4/1976 | Budinski | 60/290 |
| 3,955,364 | 5/1976 | Lewis | 60/290 |
| 3,975,905 | 8/1976 | Shimo | 60/290 |

*Primary Examiner*—Douglas Hart
*Attorney, Agent, or Firm*—Arthur N. Krein

[57] ABSTRACT

In a system for delivering secondary air from an air pump to either the exhaust manifold, preferably, closely adjacent to the exhaust ports, or to a converter in the exhaust system of an internal combustion engine, an integral air switching diverter valve assembly having an inlet connected to the air pump, a primary discharge outlet for delivery of air to the exhaust manifold and a secondary discharge outlet for delivery of air to the converter, a valve being mounted in the assembly for movement between a first or converter mode position at which it is normally positioned to allow secondary air flow to the converter while blocking secondary air flow to the exhaust manifold and a second or port mode position to allow secondary air flow to the exhaust manifold while blocking air flow to the converter, the assembly including a differential pressure operated switching diaphragm assembly used to effect movement of the valve between the port and converter modes, a divert timing assembly operative during deceleration to effect switching to the converter mode, and a pressure relief outlet which is operative during the port or converter switching modes to discharge, at a selected pressure, excess secondary air to the atmosphere.

5 Claims, 3 Drawing Figures

INTEGRAL AIR SWITCHING DIVERTER VALVE

Figure 1:
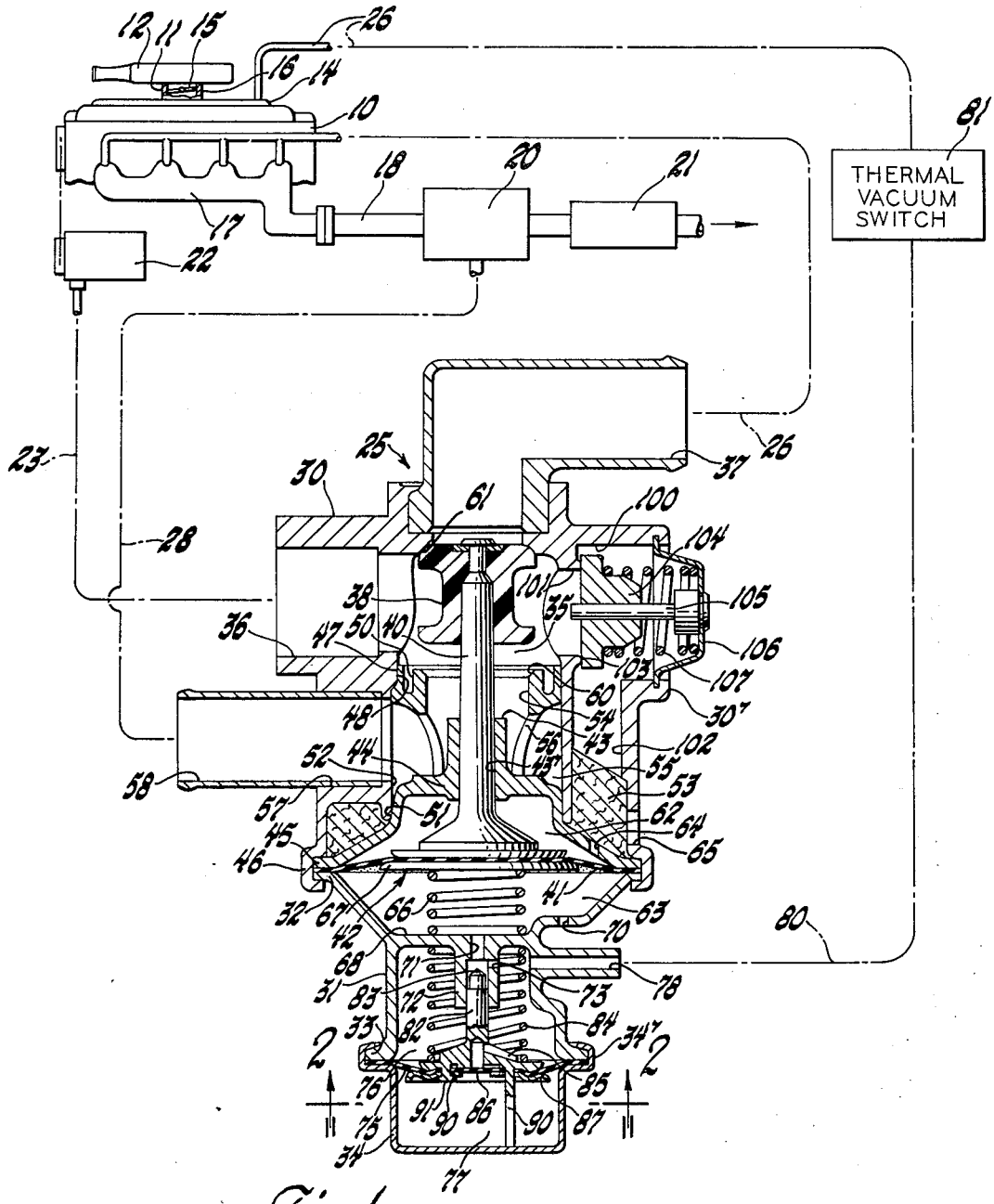

This invention relates to an air control valve for use in a system which delivers air from an air pump to the exhaust system of an internal combustion engine and, in particular, to an integral air switching diverter valve for selectively switching the flow of secondary air to an exhaust system between a port mode of operation during which air is delivered to the exhaust manifold closely adjacent to the exhaust ports or a converter mode during which air is delivered to a converter located downstream in the exhaust system from the exhaust manifold and which is operative to divert excess air.

It has been found in emission control systems for internal combustion engines of the type which include an air injection device for introducing secondary air into the exhaust system closely adjacent to the exhaust ports of an engine and a converter that, for efficient and trouble free operation, it is necessary that the delivery of secondary air be selectively sufficient to either the exhaust manifold for injection close to the exhaust ports or to the converter and that excess air be diverted from both the exhaust manifold and the converter for discharge, for example, directly to the atmosphere.

Various control systems have been proposed in the past to effect such switching or for diverting excess air to the atmosphere, as disclosed, for example, in U.S. Pat. Nos. 3,906,723 entitled "Exhaust Gas Purifying System" issued Sept. 23, 1975 to Noboru Mantumoto, Takao Nonoyama, Tutomu Tomita and Yukio Suzuki, 3,924,409 entitled "Engine Secondary Air Flow Control Valve" issued Dec. 9, 1975 to Gerald D. Heilman, Gordan R. Paddock and Ernst L. Ranft, and 3,948,045 entitled "Air Control Valve" issued Apr. 6, 1976 to John A. Budinski, Wayne V. Fannin and Raymond A. Flora. In such systems, an air pump is used to supply secondary air whereby to provide the exhaust manifold or the converter with excess oxygen to help improve exhaust emissions. A second function of such a system is to provide converter over-temperature protection.

It has now been determined that the detailed functional requirements desired for such a system are as follows:

a. vacuum or pressure operated switch signal between a so-called port mode during which air is delivered to the exhaust manifold close to the exhaust ports or a converter mode during which air is supplied to the converter.

b. divert function during deceleration to cause air to be delivered to the converter while blocking discharge of air to the exhaust manifold, this divert function not being necessary when the system is operating on a converter mode.

c. with unexpected loss of vacuum or pressure signal, secondary air must be routed to the converter.

d. a pressure relief feature must be provided during the port or converter switching modes for diverting excess air flow to the atmosphere when the secondary air pressure exceeds a predetermined value.

It is therefore the primary object of this invention to provide an air switching valve and a diverter valve assembly that is operative to perform all of the above identified functions, such an air switching diverter valve assembly being a unitary structure.

Another object of this invention is to provide an air control valve for use in an exhaust emission control system for an internal combustion engine in which air from an air pump is delivered to the exhaust system either to the exhaust manifold or to the converter, wherein the air control valve is operative to effect air switching, divert and relief functions all combined into an integral package.

These and other objects of the invention are obtained in an air control valve for use in a system for delivering secondary air to the exhaust system of an internal combustion engine, wherein the air control valve includes a housing having an inlet for receiving secondary air and opening into a central chamber within the housing, a primary outlet and a secondary outlet in the housing extending from diametrically opposite sides of the central chamber with a valve movably positioned in the central chamber for the selective control of discharge through either the primary outlet or the secondary outlet, a switching diaphragm assembly has its diaphragm operatively connected to the valve and positioned in the housing to form with a portion thereof a chamber open to the atmosphere and an actuating chamber on opposite sides of the diaphragm, the actuating chamber being open through a bleed orifice to the atmosphere and operatively connected, as controlled by a control valve, to a signal source of actuating fluid, the control valve being operatively connected to the diaphragm of a divert timing assembly positioned in the housing with the diaphragm of the divert timing assembly forming with a portion of the housing a vacuum chamber on one side of the diaphragm that is connected to a source of engine vacuum and a timing chamber on the opposite side of the diaphragm, a pressure relief valve controlled outlet being positioned in the housing in flow communication with the central chamber whereby to permit discharge of air above a predetermined pressure from the air control valve assembly.

Figure 2:
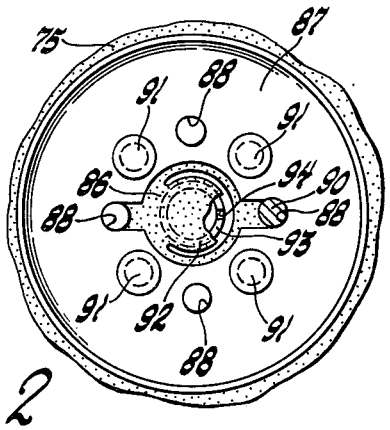
Figure 3:
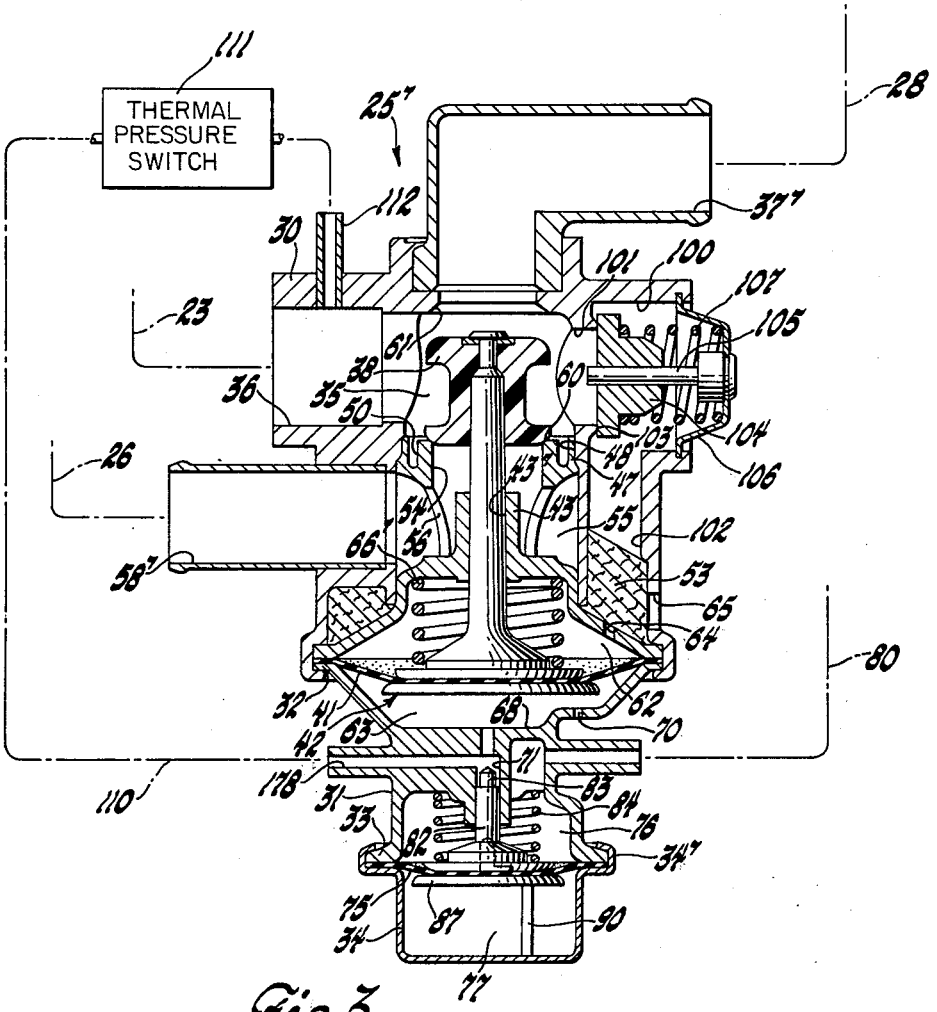

For a better understanding of the invention, as well as other objects and further features thereof, reference is had to the following detailed description of the invention to be read in connection with the accompanying drawings, wherein:

FIG. 1 is a schematic view of an internal combustion engine having an air pump for delivering secondary air to the exhaust system for the engine and having incorporated therein an integral air switching diverter valve in accordance with a preferred embodiment of the invention, this valve assembly being shown in enlarged sectional elevational view disposed between the air pump and the exhaust system;

FIG. 2 is a view taken along line 2—2 of FIG. 1, further enlarged, to show the divert timing valve arrangement; and, FIG. 3 is a sectional elevational view of an alternate embodiment of an integral air switching diverter valve in accordance with the invention.

Referring now to FIG. 1, an internal combustion engine 10 is provided, for example, with a carburetor 11 and an air cleaner 12 mounted thereon to supply an air-fuel mixture to the intake manifold 14 of the engine, primary air flow through the carburetor to the engine being controlled by a throttle valve 15 pivotal within the induction passage 16 of the carburetor. An exhaust manifold 17 receives the exhaust gases discharged through the exhaust ports (not shown) from the cylinders (not shown) of the engine and defines a flow path for the combustible exhaust gases discharged therefrom. Each exhaust manifold 17 is connected to an exhaust pipe 18 which, in turn, is connected to a catalytic converter 20 and a muffler 21.

An air pump, such as an engine driven air pump 22, delivers clean secondary air via a conduit 23 to an integral air switching diverter valve, generally designated 25, in accordance with a preferred embodiment of the invention, which is operative in a manner to be described to effect delivery of secondary air either through a conduit 26 to the exhaust manifold 17 for discharge closely adjacent to the exhaust ports (not shown) of the engine on the downstream side thereof or, via a conduit 28 to the converter 20.

The integral air switching diverter valve assembly 25, in the construction shown in FIG. 1, includes a multiple piece housing having as major elements thereof an upper body 30, an intermediate body 31 provided with upper and lower flanges 32 and 33, respectively, and a lower cup-shaped cover or body 34 suitably secured together in a manner to be described. The upper body 30 is formed with a central stepped opening extending upward from the lower portion thereof, to provide a central chamber 35 at the upper end of upper body 30 and with a lateral air inlet passage 36 from a side thereof which is connected at one end to conduit 23 and has its other end opening into the central chamber 35. A primary outlet passage 37 in the upper body 30 has one end thereof opening into the central chamber 35 and has its other end connected by conduit 26 to the exhaust manifold 17.

A valve member 38 is movably positioned in the central chamber 35 and is secured to the upper end of a valve stem 40, the lower end of the valve stem being suitably secured to the diaphragm 41 of a switching diaphragm assembly, generally designated 42. The valve stem 40 is sealingly guided for reciprocal movement in the valve guide bore 43' in the central guide portion 43 of an insert member 44 which is secured about its lower rim 45 together with the outer peripheral edge of diaphragm 41 between the lower rim 46 of upper body 30 and the upper flange 32 of intermediate body 31. The upper rim 47 of insert member 44 is pressed into the bore portion 48 of upper body 30, a deep groove 50 in the upper rim 47 facilitating the press fit. In addition, the intermediate rim 51 of the insert member 44 is in sealing engagement with the annular inner wall of the bore portion 52 of the upper body 30 whereby to define an annular chamber, preferably filled with noise suppressor or silencing material 53, between the upper surface of the lower portion of insert member 44 and the lower portion of the upper body 30.

Insert member 44 has a cylindrical recess 54 surrounding the guide portion 43 and the intermediate portion of the insert member between the upper rim 47 and the intermediate rim 51 forms with the interior of the upper body an annular chamber 55 which is in communication with the cylindrical recess 54 by means of openings 56 through the annular wall of the insert member 44. A second lateral passage 57 is provided through the upper body 30 to open into the annular air chamber 55. In the construction shown, a secondary outlet tube 58 is positioned in lateral passage 57, with one end of the outlet tube 58 being connected by conduit 28 to the converter 20 and the other end opening into the air chamber 55. The outlet tube 58, air chamber 55, openings 56 and recess 54 form, in effect, a secondary outlet passage of the valve assembly.

The upper periphery of recess 54 defines a lower valve seat 60 which is engageable by the valve member 38 and which is positioned in axial alignment, relative to the axis of valve stem 40, with an upper valve seat 61 surrounding the primary outlet passage 37.

In the construction shown, the lower rim 46 of upper body 30 is spun over the lower rim 45 of insert member 44, the peripheral edge of switching diaphragm 41 and the upper flange 32 of intermediate housing 31 whereby to provide an upper chamber 62 and a lower chamber 63 on opposite sides of the diaphragm, the upper chamber being defined as an atmospheric chamber since it is in communication, via one or more apertures 64 in the lower portion of the insert member 44 with the annular chamber filled with the silencing material 53 and then via one or more radial ports 65 through the outer side wall of the upper body 30 with the atmosphere.

The lower chamber 63 has a coiled spring 66 positioned therein, one end of the spring abutting against the diaphragm retainer 67 suitably fixed to the lower end of the valve stem 40 with the diaphragm 41 sandwiched therebetween and, the opposite end of the spring 66 abuts against the intermediate web wall 68 of intermediate body 31 whereby the valve member 38 is normally biased against the valve seat 61 to thereby block flow of air from chamber 35 out through the primary discharge outlet 37 to the exhaust manifold 17 while permitting air to be discharged out through the secondary discharge outlet tube 58 to the converter 20.

The lower chamber 63 may be referred to as a switch actuating chamber or in this embodiment as a secondary vacuum chamber for a reason and in a manner to be described. As shown, this switch actuating or secondary vacuum chamber 63 is always in communication via a restricted orifice passage 70 through the outer wall of the intermediate body 31 to the atmosphere and, this chamber is also connected via a stepped bore 71 extending through a boss 72 depending from and formed integral with the web wall 68 and a radial port 73 through this boss to be in communication with the vacuum chamber of a divert timing assembly as controlled thereby in a manner to be described.

This divert timing assembly includes a diaphragm 75 which is used to control the movement of a control valve, to be described, which is used to control the application of a signal pressure, such as signal vacuum to the switch actuating or secondary vacuum chamber 63. As shown, the diaphragm 75 has its outer peripheral edge sandwiched between the lower flange 33 of the intermediate body 31 and the upper rim 34' of lower body 34, these elements being suitably secured together, as by having the upper rim 34' spun over flange 33, whereby the diaphragm 75 forms with the lower inverted cup portion of the intermediate body 31 and the cup-shaped lower body 34, a vacuum chamber 76 on one side, the upper side, of the diaphragm and a second vacuum or timing chamber 77 on the opposite or lower side of the diaphragm. A lateral passage 78 in the bottom wall of the intermediate body 31 opens at one end into the vacuum chamber 76 and is connected at its other end by a conduit 80 to a source of manifold vacuum, such as the intake manifold 14 downstream of the throttle 15, with flow through conduit 80 being controlled by a step function thermal vacuum switch 81 which is suitably positioned to be responsive to the operating temperature, for example, of the engine or exhaust system. The thermal vacuum switch 81 provides full manifold vacuum to vacuum chamber 76 when, for example, the engine 10 is cold and zero vacuum when the engine reaches some predetermined operating temperature.

Fixed to and extending upward from the diaphragm 75 is a control valve stem 82 that is reciprocably journaled in the enlarged bore portion of bore 71, the valve stem 82 having at its free end a conical control valve head 83 adapted to be received in the reduced diameter portion of the bore 71 in position to block flow therethrough. A coiled spring 84 is positioned in the vacuum chamber 76 with one end of the spring abutting against the underside of the web wall 68 and its other end abutting against the lower flanged end of the control valve stem 82 whereby to normally bias it and therefore its head 83 to an open position, the position shown, relative to the reduced diameter portion of bore 71 whereby the vacuum chamber 76 is normally in direct communication with the secondary vacuum chamber 63 of the switching diaphragm assembly through the passages previously described.

Control valve stem 82 has a passage 85 therein used to connect vacuum chamber 76 with the timing chamber 77, with a flat type check valve 86 being disposed to regulate flow through the passage 85 into timing chamber 77. The details of the check valve 86 are shown most clearly in FIG. 2. A diaphragm retainer in the form of a washer 87 is positioned under diaphragm 75 and it is provided with a plurality of apertures 88 which receive the alignment pins 90 formed on the lower portion of the valve stem 82. Four of these alignment pins 90 are of relatively short length and are riveted as at 91 to retain the washer 87 to the control valve stem with the diaphragm 75 sandwiched therebetween. At least one of the other alignment pins 90 is of a suitable length so as to engage the inner bottom surface of lower body 34 whereby to limit axial displacement of the control valve in one direction, the downward direction, as seen in FIG. 1.

The outer rim of the check valve 86 is supported by the inner rim of the washer 87. A central flap 92 of the check valve 86 overlies an annular valve seat 93 formed in the base of the control valve stem 82. A notch 94 is coined in the seat 93. During the period when manifold vacuum in vacuum chamber 76 is increasing, flow from timing chamber 77 through the passage 85 to chamber 76 is restricted to pass only through the notch 94. Thus, the volume of the timing chamber 77 and the size of the notch 94 determine the time required for the pressure in timing chamber 77 to be reduced to the point where spring 84 will lower diaphragm 75 and the control valve stem 82 with its head 83 to the position shown in FIG. 1. During a period of increasing pressure in chamber 76, the central flap 92 will be pushed downwardly to allow unrestricted flow from the chamber 76 through passage 85 to timing chamber 77 and thus permit immediate return of the diaphragm 75 and the control valve stem 82 with its head 83 to the position shown. In this position, the vacuum chamber 76 is in direct communication with the secondary vacuum chamber 63.

Pressure relief from the valve assembly 25 is effected by a relief assembly incorporated into this valve structure. As shown, the upper body 30 has a pressure relief passage 100 extending from a lateral opening 101 opening into the side of the central chamber 35 diametrically opposite inlet 36. The pressure relief passage 100 includes an axially extending channel 102 provided in one side of the upper body 30 to open into the top of the annular chamber having the noise suppressor material 53 therein.

A valve seat 103 is formed about opening 101 and is engaged by a valve member 104 which slides on a shaft 105 suitably fixed at one end to a cover 106 that is secured to the upper body 30 as by a spun over portion 30' thereof.

The pressure relief feature is provided by a calibrated spring 107 which normally biases valve member 104 against the valve seat 103 until the pump discharge pressure in the central chamber 35 rises above a predetermined level. At that level, valve member 104 is moved axially in a direction on the shaft 105 whereby it unseats from the valve seat 103 and a portion of the air flow through inlet 36 into the central chamber 35 is diverted through the channel 102 for discharge to the atmosphere through the radial ports 65.

As previously described, the valve member 38 is normally biased by the spring 66 into engagement with the valve seat 61 blocking flow through the primary discharge outlet 37 while permitting flow out through the secondary outlet tube 58 and thus, any time when there is no signal vacuum provided to the actuating chamber 63, switching from the primary discharge outlet 37 to the secondary discharge outlet 58 will occur. During engine operation, signal vacuum will be provided to the valve assembly 25 through conduit 80 under control of the stepped function thermal vacuum switch 81, which provides full manifold vacuum through the lateral passage 78 into the vacuum chamber 76 when the engine is cold and zero vacuum when the engine 10 reaches some predetermined operating temperature. Thus, upon the start of engine operation and when air to the exhaust ports of the engine is required, a signal vacuum is applied through the conduit 80 and thermal vacuum switch 81 to the lateral passage 78 to the vacuum chamber 76. This vacuum is transmitted from the chamber 76 through the radial port 73 and the stepped bore 71 to the actuating chamber 63. The presence of sufficient vacuum in actuating chamber 63 causes the switching diaphragm assembly with atmospheric pressure on one side of diaphragm 42 and the signal vacuum on the other side thereof to overcome the bias of spring 66 causing the valve member 38 to seat on valve seat 60, which of course then permits air to flow out through the primary discharge outlet 37, the valve assembly thus being in the port mode of operation while blocking flow to the converter. In a particular embodiment, secondary air flow through the primary discharge outlet 37 to the exhaust manifold 17 is maintained as long as a minimum of 2.0 in. Hg. is present in the actuating chamber 63. When the vacuum signal applied through the lateral passage 78 into the vacuum chamber 76 is, in effect, eliminated, that is, when a pressure less than the above identified vacuum pressure is in this chamber, then the vacuum in the actuating chamber 63 can be effectively dissipated by atmospheric air entering through the bleed orifice 70 into this chamber, which then causes the spring 66 to effect movement of the valve member 38 in a direction to seat against the valve seat 61 thereby blocking flow of secondary air out through the primary discharge outlet 37 while permitting secondary air flow to be discharged out through the secondary outlet tube 58, this being the converter mode of operation of this valve assembly.

If a signal vacuum of 2.0 in. Hg. or higher is being provided through the lateral passage 78 to the vacuum chamber 76 and the engine then experiences a deceleration condition (ie., high manifold vacuum), a high vacuum peak is experienced in chamber 76. This will cause the divert timing diaphragm 75 to move upward against the biasing action of spring 84 causing the control valve stem 82 to move upward, from the position shown in FIG. 1, whereby the valve head 83 will be positioned to block flow through the small diameter portion of the stepped bore 71. This blocks the vacuum in the vacuum chamber 76 from entering actuating chamber 63 which then permits the residual signal vacuum in the chamber 63 to become eliminated by the flow of atmospheric air through the bleed orifice 70 into this chamber. This will then permit the spring 66 to push the valve member 38 against the valve seat 61 to block the flow of secondary air out through the primary discharge passage 37 to the exhaust manifold and thereby preventing exhaust backfire. After a predetermined time established by the bleed notch 94 in the divert timing assembly, the vacuum peak experienced in chamber 76 during deceleration would be equalized with that in the timing chamber 77 and the divert timing assembly would then return to the position shown in FIG. 1 with the long stop pin 90 resting on the lower body 34, with the valve head 83 then being in an open position to permit fluid communication between the vacuum chamber 76 and the actuating chamber 63. This would cause a signal vacuum to again be present in the actuating chamber 63 resulting in movement of the valve member 38 in a direction to permit air flow again out through the primary discharge outlet 37.

The divert timing assembly will only operate during relatively cold engine operation when a signal vacuum is available at the lateral passage 78, it being apparent from the construction shown that the divert function is not necessary when the valve member 38 is switched to the converter mode of operation whereby air is only being discharged through the secondary discharge tube 58 to the converter 20. It will be apparent that by calibration of the divert timing spring 84, the vacuum differential across the diaphragm 75 necessary for divert operation may be adjusted, as desired, and that this parameter can be adjusted for each particular type engine system for backfire prevention.

An alternate embodiment of the air switching diverter valve which utilizes the principles of the present invention is shown in FIG. 3, wherein similar parts are designated by similar numerals, but with the addition of a suffix where appropriate. The embodiment of the valve assembly 25' shown in FIG. 3 differs from that shown in FIG. 1 in that, the discharge outlets to the exhaust manifold (port mode) and to the converter (converter mode) are reversed to maintain the desired converter mode of operation if the signal pressure, to be described, to effect operation of the switching diaphragm assembly is lost. That is, in this alternate embodiment, the discharge outlet 37' would be connected by conduit 28 to the converter 20, thus this outlet 37' would now be referred to as the secondary discharge outlet, while the oulet tube 58' would be connected by conduit 26 to the exhaust manifold 17, thus this outlet, formed in part by outlet tube 58', would now be referred to as the primary discharge outlet. Also in this embodiment, the spring 66' is positioned in chamber 62 whereby to normally bias the valve member 38 in a direction to seat against the valve seat 60 thereby preventing air flow between the chamber 35 and the outlet tube 58'.

In this alternate embodiment, the switch signal for the actuating chamber 63 is provided by air at pump 22 discharge pressure. For this purpose, as shown in FIG. 3, the actuating chamber 63 is connected by the passage provided by the stepped bore 71 and by a lateral signal passage 178, which intersects the stepped bore 71, to one end of a supply conduit 110, flow through which is controlled by a stepped function thermal pressure switch 111, the opposite end of conduit 110 being secured, in the construction illustrated, to a tube fitting 112 opening into the inlet passage 36 of the valve assembly 25'. The stepped function thermal pressure switch 111 is suitably positioned so as to be operative, for example, as a function of the engine 10 operating temperature. Thus, signal pressure from the air pump flowing to the conduit 110 is provided to the signal passage 178 during cold engine operation and eliminated when the engine 10 reaches some predetermined operating temperature. Flow of signal pressure air from the signal passage 178 through the passage provided by the bore 71 to the actuating chamber 63 is controlled by the head 83 of the control valve as actuated by the divert timing assembly of this valve assembly 25', which divert timing assembly is similar to that previously described with reference to FIG. 1. Manifold vacuum is applied to the lateral passage 78 of the valve assembly 25' in the same manner as previously described so as to perform the same divert function in this valve assembly 25' as performed in the valve assembly 25.

In the valve assembly 25', the valve member 38, as previously described, in normally biased by the spring 66' into engagement with the valve seat 60 thereby preventing flow out through the outlet tube 58' connected to the exhaust manifold while permitting flow out through the outlet passage 37' which is connected to the converter 20 and thus, at any time when there is no signal pressure, above a predetermined pressure relative to atmospheric pressure, applied to the actuating chamber 63, the valve member 38 will be in the above described position to block flow out through the outlet tube 58'. During engine operation, signal pressure will be provided through the conduit 110 under control of the stepped function thermal pressure switch 111 to the actuating chamber 63 so that when the engine is cold, air above atmospheric pressure, as supplied from the air pump 22, will be delivered to the actuating chamber 63 and this supply of air to the actuating chamber will be terminated when the engine reaches some predetermined operating temperature.

It will thus be apparent, that when the actuating chamber 63 is supplied with air of a sufficient pressure, as provided by the pump 22, it will cause the switching diaphragm assembly to move upward, with reference to FIG. 3, against the biasing action of spring 66' to move the valve member 38 in a direction whereby it becomes unseated from the valve seat 60 and seated against the valve seat 61. When this occurs, air from central chamber 35 will be discharged through the outlet tube 58' to the exhaust manifold while air flow will be blocked to the converter 20.

When the signal pressure to the actuating chamber 63 is terminated, either through the operation of the thermal pressure switch 111 or by the control valve head 83, as moved by the divert timing assembly in a manner previously described, then the pressure in the actuating chamber 63 will be dissipated by air flow out through the bleed orifice 70 so that the pressure on opposite sides of diaphragm 41 will be substantially equalized whereby the spring 66' can again effect movement of the valve member 38 to effect its seating against the valve seat 60 whereby to block flow from the central chamber out through the outlet tube 58' to the exhaust manifold while permitting air to be discharged to the converter 20.

What is claimed is:

1. An integral air switching diverter valve for use with an engine having an induction system with a throttle movable therein and an exhaust emission control system including an exhaust manifold connected to the engine and an exhaust conduit for receiving exhaust gases discharged from the exhaust ports of the engine and defining a flow path for passing the exhaust gases through a converter and, a driven air pump for providing secondary air, said integral air switching diverter valve including a housing means having passage means defining an inlet flow path for receiving said secondary air, a primary discharge flow path for delivery of air to said exhaust manifold and a secondary discharge flow path for delivery of air to said converter, one end of each of said inlet flow paths, said primary discharge flow path and said secondary discharge flow path opening into a valve chamber in said housing means with said one end of said primary discharge flow path being axially aligned in spaced apart relation to said one end of said secondary discharge flow path, a valve means including a valve head positioned in said valve chamber for movement between a first position blocking said one end of said primary discharge flow path and a second position blocking said one end of said secondary discharge flow path, said valve means further including actuator means operatively connected to said valve head, said actuator means including a diaphragm forming with a first portion of said housing means a pressure chamber open to the atmosphere on one side of said diaphragm and on its other side a non-atmospheric pressure actuator chamber, a bleed orifice means in said housing means in communication at one end with said actuator chamber and at its other end in communication with the atmosphere, a passage means having one end in communication with said actuator chamber and connectable at its other end to a source of non-atmospheric pressure fluid, and a second valve means operatively positioned in said housing means for movement to control flow through said passage means, said second valve means including a second actuator means having a diaphragm with a timing valve means therein forming with a second portion of said housing means a vacuum chamber on one side of said diaphragm connected to the induction system downstream of the throttle and a timing chamber on the opposite side of said diaphragm, said timing chamber being in fluid communication with said vacuum chamber as controlled by said timing valve means.

2. An integral air switching diverter valve according to claim 1 wherein said housing means further includes a bypass outlet opening from said valve chamber, said bypass outlet having a one-way pressure relief valve means positioned therein to control flow from said valve chamber out through said bypass outlet, wherein a spring means is positioned in said actuator chamber to normally bias said diaphragm and therefore said valve head into a position blocking flow from said air chamber out through said primary discharge flow path and, wherein said passage means is in communication at one end with said actuator chamber and at its other end with said vacuum chamber.

3. An integral air switching diverter valve according to claim 1 wherein said housing means further includes a bypass outlet opening from said valve chamber, said bypass outlet having a one-way pressure relief valve means positioned therein to control flow from said valve chamber out through said bypass outlet, wherein said passage means is connected at its opposite end to said inlet flow path whereby said actuator chamber is supplied with secondary air as supplied by the air pump, and wherein, a spring means is positioned in said pressure chamber to normally bias said diaphragm and therefore said valve head into a position to normally block flow through said primary discharge flow path.

4. An air switching diverter valve for use with an internal combustion engine having an induction system, an exhaust emission control system including an exhaust manifold connected to the engine and an exhaust conduit for receiving exhaust gases discharged from the exhaust ports of the engine and defining a flow path for delivering the exhaust gases through a converter and, an engine driven air pump for supplying secondary air via said air switching diverter valve to a first conduit connected to the exhaust manifold and a second conduit connected to the converter, said air switching diverter valve including a valve housing means defining a valve chamber having an inlet connected to the air pump, a first outlet connected to the first conduit, a second outlet connected to the second conduit and a third outlet to the atmosphere, said third outlet having a one-way pressure relief valve means positioned therein to control flow from said valve chamber out through said third outlet when air in said valve chamber is above a predetermined pressure, said valve housing means further including a first valve seat in said valve chamber surrounding said first outlet and a second valve seat diametrically opposite said first valve seat surrounding said second outlet, a valve member positioned in said valve chamber for movement between a first position in seated engagement with said first valve seat and a second position in seated engagement with said second valve seat, a valve stem journaled for axial movement in said valve housing means and having one end thereof fixed to said valve member, a switching diaphragm operatively positioned in said valve housing means and forming therewith a pressure chamber on one side of said switching diaphragm which is open to the atmosphere and an actuator chamber on the opposite side of said switching diaphragm, bleed passage means in said valve housing means connecting said actuator chamber with the atmosphere, said opposite end of said valve stem being fixed to said switching diaphragm for movement thereby, spring means being operatively associated with said switching diaphragm to effect normal biasing of said valve member into seating engagement with said first valve seat, a divert timing diaphragm operatively positioned in said valve housing means to form with said valve housing means a vacuum chamber on one side of said divert diaphragm connected to the induction system of the engine whereby said vacuum chamber is supplied with engine vacuum and a timing chamber on the opposite side of said divert timing diaphragm, a passage means having one end in communication with said actuator chamber and its other end opening into said vacuum chamber, a control valve operatively connected to said divert diaphragm and positioned to control the flow through said passage means, and a divert timing valve control passage means associated with said control valve and said divert timing diaphragm connecting said vacuum chamber to said timing chamber and, a spring positioned in said vacuum chamber to normally bias said divert timing diaphragm and therefore said control valve to a position permitting flow between said actuator chamber and said vacuum chamber.

5. An air switching diverter valve for use with an internal combustion engine having an induction system, an exhaust emission control system including an exhaust manifold connected by an exhaust conduit to a converter and, an engine driven air pump for supplying secondary air via said air switching diverter valve to a first conduit connected to the exhaust manifold and a second conduit connected to the converter, said air switching diverter valve including a valve housing means defining a valve chamber having an inlet connected to the air pump, a first outlet connected to the first conduit, a second outlet connected to the second conduit and a third outlet to the atmosphere, said third outlet having a one-way pressure relief valve means positioned therein to effect discharge of air above a predetermined pressure from said valve chamber out through said third outlet, said valve housing means further including a first valve seat in said valve chamber surrounding said first outlet and a second valve seat, diametrically opposite said first valve seat, surrounding said second outlet, a valve member positioned in said valve chamber for movement between a first position in seated engagement with said first valve seat and a second position in seated engagement with said second valve seat, a valve stem journaled for axial movement in said housing means and having one end thereof extending up through said first valve seat coaxially thereof and fixed to said valve member, a switching diaphragm operatively fixed to the opposite end of said valve stem and positioned in said valve housing means to form therewith a pressure chamber on the valve stem side of said switching diaphragm which is open to the atmosphere and an actuator chamber on the opposite side of said switching diaphragm, a spring means positioned in said pressure chamber to effect biasing of said valve member into engagement with said first valve seat, a bleed orifice means in said valve housing means operatively connecting said actuator chamber to the atmosphere, a passage means in said valve housing means having one end thereof in communication with said actuator chamber and having its other end opening into said inlet, a control valve positioned in said valve housing means to control flow through said passage means, a divert timing diaphragm operatively positioned in said valve housing means to form with said valve housing means a vacuum chamber on one side of said divert diaphragm which is connected to the induction system of the engine whereby said vacuum chamber is supplied with engine vacuum and a timing chamber on the opposite side of said divert timing diaphragm, said control valve extending through said vacuum chamber and being operatively connected to said divert timing diaphragm, a divert timing valve control passage means associated with said control valve and said divert timing diaphragm connecting said vacuum chamber to said timing chamber and, a spring positioned in said vacuum chamber to normally bias said divert timing diaphragm and therefore said control valve to a position permitting flow through said passage means whereby said actuating chamber is supplied with air at the pump discharge pressure.

* * * * *